US007021404B2

(12) United States Patent
Fanuel et al.

(10) Patent No.: US 7,021,404 B2
(45) Date of Patent: Apr. 4, 2006

(54) METHOD AND DEVICE FOR DEVIATED CORING AND/OR DRILLING

(75) Inventors: Philippe Fanuel, Brussels (BE); Georges Dechief, Silly (BE); Luis Quintana, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/950,877

(22) Filed: Sep. 27, 2004

(65) Prior Publication Data

US 2005/0072598 A1 Apr. 7, 2005

Related U.S. Application Data

(63) Continuation of application No. PCT/BE03/00054, filed on Mar. 25, 2003.

(30) Foreign Application Priority Data

Mar. 27, 2002 (BE) ..... 2002/0223

(51) Int. Cl.
*E21B 7/04* (2006.01)

(52) U.S. Cl. ..... 175/61; 166/298; 175/244; 175/387; 175/403

(58) Field of Classification Search ..... 166/55, 166/298; 175/61, 80, 82, 244, 254, 332, 175/387, 403

See application file for complete search history.

(56) References Cited

U.S. PATENT DOCUMENTS

| | | | | |
|---|---|---|---|---|
| 5,029,653 | A | 7/1991 | Jurgens et al. | 175/58 |
| 5,148,875 | A | 9/1992 | Karlsson et al. | 175/62 |
| 6,202,752 | B1 | 3/2001 | Kuck et al. | 166/298 |

FOREIGN PATENT DOCUMENTS

| | | |
|---|---|---|
| GB | 575.685 | 2/1946 |
| WO | 90/00666 | 1/1990 |
| WO | 98/04804 | 2/1998 |
| WO | 03/080987 | 10/2003 |

OTHER PUBLICATIONS

PCT International Preliminary Examination Report for International Application No. PCT/BE03/00054, 4 pages, Mar. 3, 2004.

PCT International Search Report for International Application No. PCT/BE03/00054, 4 pages, Jun. 13, 2003.

*Primary Examiner*—Zakiya Walker
(74) *Attorney, Agent, or Firm*—Baker Botts L.L.P.

(57) ABSTRACT

The invention concerns a method and a device for coring and/or drilling through a wall of a bore hole, to deflect transversely from a longitudinal direction of the hole, further comprising selecting a core barrel (1) equipped with a core bit (3) having an inner gauge bore (5), an arrangement, in the core barrel (1), of an abrasion resistant internal guide (7), which is internal at least with respect to the bore (5) so that the bit (3) can move along guide (7), and is designed to deflect the bit (3) along a desired deflected path, start-up of the coring process with bit (3) and guiding the bit (3) through co-operation between its bore (5) and the guide (7).

17 Claims, 12 Drawing Sheets

METHOD AND DEVICE FOR DEVIATED CORING AND/OR DRILLING

RELATED APPLICATIONS

This application is a Continuation Application of International Application Serial No. PCT/BE03/00054 entitled METHOD AND DEVICE FOR DEVIATED CORING AND/OR DRILLING, filed on Mar. 25, 2003, which claims priority to Belgian Application Serial No. 2002/0223 filed on Mar. 27, 2002.

TECHNICAL FIELD OF THE INVENTION

The present invention concerns a method for coring and/or drilling through a wall of a bore hole which has been cored or drilled previously in an underground formation, in order to carry out coring and/or drilling deviated transversely from and with respect to a longitudinal direction of the bore hole.

BACKGROUND OF THE INVENTION

Methods and devices for coring and/or drilling through a wall of a bore hole which has been cored or drilled previously, are known in which there are installed in the bore hole deviation means which act on the outside of the drilling auger or of the core bit. Installing these means at precise locations and orientations of the bore hole is complicated and expensive.

SUMMARY OF THE INVENTION

The aim of the present invention is to remedy this problem and propose a method in which a core barrel carries, at least for the time to carry out the deviation operation, its own guidance means. Thus, by directly setting the depth to which the core barrel is lowered to start the deviation, the location from which a deviated coring can start is set immediately.

To that end, the method of the invention comprises, besides selection of a core barrel provided with a core bit having an inner gauge bore, arrangement, in the core barrel, of an internal guide which is made of a material resistant to the abrasion of the bit; moreover, before beginning a deviated coring, said guide is inside at least the inner gauge bore, so that the bit can move along this internal guide. The guide extends in front of the bit, according to a forward direction of coring thereof, and is arranged to progressively deviate the bit from said longitudinal direction towards the wall, following a desired deviated path direction. The method next comprises start-up of the coring with said bit and guidance of the bit through cooperation between its inner gauge bore and the internal guide, until said wall and the formation are penetrated to a desired depth following the deviated path.

According to one embodiment of the invention, there is fixed in a detachable manner to the bit, and in front thereof according to its forward direction of coring, a destructible element which is made of a material chosen so that it can be destroyed by the bit in the process of coring along the deviated path, and which has dimensions chosen in order to go into the bore hole. A guidance means arranged to give the deviated path direction is fixed in the destructible element.

According to one advantageous embodiment of the invention, the above-mentioned internal guide is used as the guidance means in the destructible element, and the destructible element is fixed to the wall of the bore hole at a location chosen for a deviated coring. Next, breaking of the detachable fixing between the bit and the destructible element is caused, and the bit is set rotating and pushed forward in order to follow the deviated path given by the internal guide, destroying the part of the destructible element which it encounters and penetrating said wall and the formation to a desired depth.

It should be noted that in this case the internal guide is fixed in the bore hole by the destructible element, until the bit has completely detached it from the destructible element.

According to another advantageous embodiment of the invention, the method comprises, before the deviated coring proper, arrangement, as the guidance means in the destructible element, of a guidance channel, one end of which is substantially coaxial with the inner gauge bore and whose line corresponds to the desired deviated path. There is then disposed, in particular in steps, a drilling machine, carried by a drilling string, through the core barrel and the inner gauge bore and following the guidance channel. Drilling by the machine in the wall of the bore hole according to the deviated path given by said channel is organized, the drilling string having a length chosen in order that, when the drilling machine is driven into the wall according to a chosen anchorage depth, the drilling string is still engaged in at least the inner gauge bore of the bit. Next, breaking of the detachable fixing between the bit and the destructible element is caused, and the bit is set rotating and pushed forward following the deviated path given by the drilling string and the drilling machine, in order to destroy the part of the destructible element and of said guidance channel which it encounters and to penetrate said wall and the formation to a desired depth.

It should be noted that in this case the internal guide is sent and embedded in the wall of the bore hole beforehand, in order to be fixed there, before the bit is activated. Next, the activated bit will be advanced along the internal guide until the latter is freed from its fixing in said wall. Provision can then be made for withdrawal of said internal guide through the core barrel when the latter has been deviated.

According to yet another advantageous embodiment of the invention, the method comprises, before the deviated coring proper, arrangement, as the guidance means in the destructible element, of a guidance channel, one end of which is substantially coaxial with the inner gauge bore and whose line corresponds to the desired deviated path. In this case the destructible element is fixed to said wall of the bore hole at the location chosen for the deviation. A drilling machine, carried by a drilling string, is arranged through the core barrel and the inner gauge bore and so that it follows the guidance channel in the direction of said wall. The drilling machine is fixed to the core barrel, so that it projects by a given distance outside the bit into the guidance channel. The detachable fixing between the bit and the destructible element is broken and the bit and the drilling machine are set rotating and pushed forward and drilling by the machine in the wall of the bore hole is caused, according to said deviated path given by the guidance channel, and coring by the bit is caused following the deviated path given by the drilling string and the drilling machine, destroying the part of the destructible element and of said guidance channel which it encounters and penetrating said wall and the formation to a desired depth.

It should be noted that in this case the internal guide moves in front of the bit, at the same time, and in principle by the same amount, as the bit but a withdrawal of said internal guide through the core barrel when the latter has been deviated can also be organized.

The invention also concerns a device for coring and/or drilling through a wall of a bore hole which has been cored or drilled previously in an underground formation, in order to carry out coring and/or drilling deviated transversely from and with respect to a longitudinal direction of the bore hole.

The device of the invention comprises a core barrel, provided with a core bit having an inner gauge bore, and an internal guide which is made of a material resistant to the abrasion of the bit, which, before beginning a deviated coring, is inside at least the inner gauge bore, so that the bit can move along this internal guide, which extends in front of the bit, according to a forward direction of coring thereof, and is arranged to progressively deviate the bit from said longitudinal direction towards the wall, and which is kept fixed in order to give the bit the desired deviation direction.

Other details and particular features of the invention will emerge from the secondary claims and from the description of the drawings accompanying the present document and which illustrate, by way of non-limiting examples, the method and particular embodiments of the device according to the invention.

BRIEF DESCRIPTION OF THE DRAWINGS

FIGS. 1 to 4 show the first embodiment, FIG. 1 showing the front end thereof, FIG. 2 showing a following section in the direction towards the rear end, FIG. 3 showing the section following that of FIG. 2, and FIG. 4 showing the rear section to be connected to a drilling string.

FIGS. 5 to 9 show in the same way the second embodiment in its deviation guidance mounting, FIG. 5 showing the front end of the device and FIG. 9 showing the rear section to be connected to a drilling string.

FIGS. 10 to 12 show in the same way the second embodiment in its coring mounting.

FIGS. 13 to 17 show in the same way the third embodiment in its deviation guidance mounting, FIG. 13 showing the front end of the device and FIG. 17 showing the rear section to be connected to a drilling string.

FIGS. 18 to 20 show in the same way the third embodiment in its coring mounting.

DETAILED DESCRIPTION OF THE INVENTION

Figure 2:
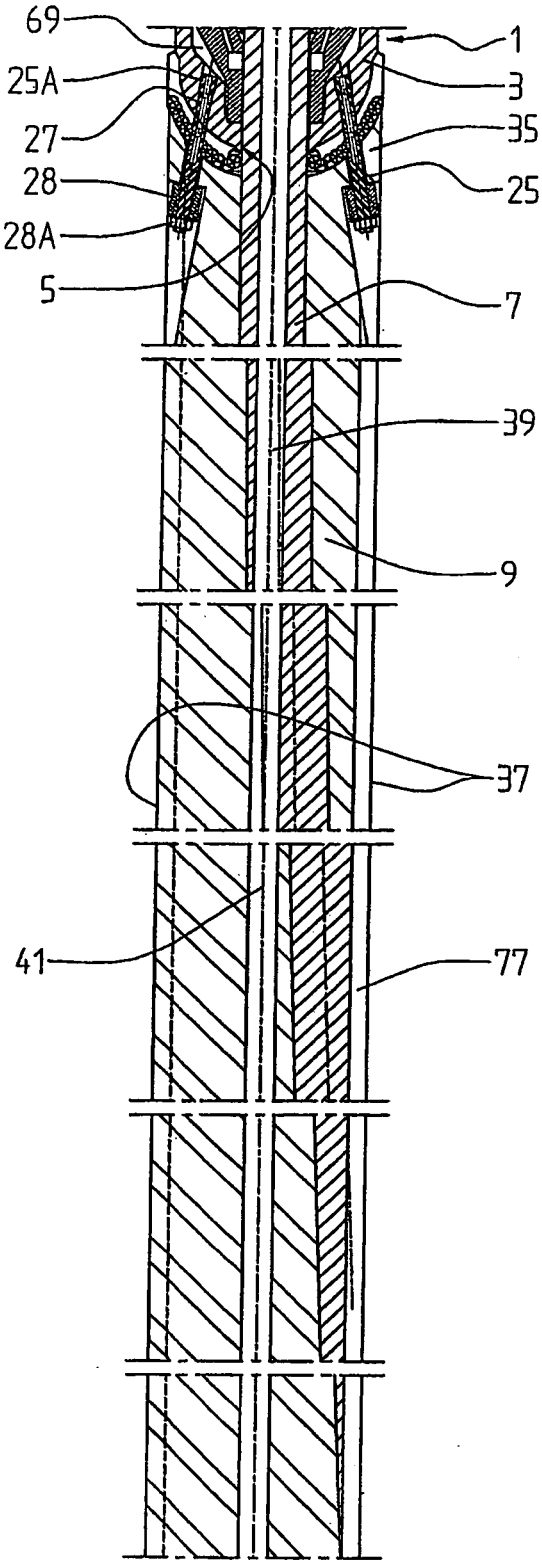
FIGS. 1 to 20 depict schematically without specific scales, in cross-section along the longitudinal axis and with breaks, different successive sections of three different embodiments of a device according to the invention. Said figures are oriented in the same direction, the front end of a section being at the bottom of the drawing, and the rear end being at the top. In one and the same embodiment, the rear end of a section of one figure is to be followed by the front end of the section of the following figure, the location of fixing of the destructible element to the bit being reproduced on two consecutive figures.

In the different figures, the same reference notations designate identical or analogous elements. However, in the third embodiment, certain elements of similar kind and/or function as those of the second embodiment, but different in their design, will receive the same number with the letter "t" added.

For clarity of explanation, a description is given first of the device of the invention intended for deviated coring and/or drilling, through a wall of a bore hole (not depicted) which has been cored and or drilled previously in an underground formation (not depicted).

According to one of its embodiments, the device of the invention (FIGS. 1 to 4) comprises in particular, on the one hand, a core barrel 1 provided with a core bit 3 (FIG. 1) having an inner gauge bore 5 and, on the other hand, an internal guide 7 which is made of a material resistant to the abrasion of the bit 3, in particular to that of the abrasive elements usually disposed in its inner gauge bore 5. Before beginning a deviated coring, the internal guide 7 is arranged inside at least the inner gauge bore 5, so that the bit 3 can move along this internal guide 7. Moreover, the internal guide 7 extends in front of the bit 3, according to a forward direction of coring thereof, and is arranged to progressively deviate the bit 3, from said longitudinal direction of the bore hole fashioned previously, towards the wall of this bore hole. The internal guide 7 is kept fixed with respect to said wall in order to give the bit 3 the desired deviation direction.

Hereinafter, front end of an element will designate the one closest to the bottom of the bore hole when the core barrel 1 is disposed therein in the coring position, and rear end of an element will designate the one closest to a derrick to which said core barrel 1 is connected for the coring.

Said device of the invention can comprise in addition a destructible element 9 which is fixed in a detachable manner in front of the bit 3, according to the forward direction of coring thereof, and which is made of a material chosen so that it can be destroyed by the bit 3 in the process of coring along the deviated path. The destructible element 9 has dimensions chosen in order to go into the bore hole.

The destructible element 9 can be made of any known material, composite or not, which the bit 3 can destroy on its passage without it becoming unnecessarily worn, but which can keep the guidance means 11 and/or the internal guide 7 in place sufficiently effectively. To that end it can be a block of cement, polyester, composite material, etc.

In the destructible element 9 there is fixed a guidance means 11 arranged to give the deviated path direction that the bit 3 has to follow.

The destructible element 9 can comprise a means 13 for its selective fixing to the wall of the bore hole.

Said selective fixing means 13 can comprise an annular sleeve 15, made of elastic material, which is mounted on a peripheral lateral surface part of the destructible element 9 and whose external diameter at rest passes freely into the bore hole but which can be expanded selectively until it becomes wedged against the wall of the bore hole, means 17 being provided to cause this expansion and retain it. The annular sleeve 15 is for example fixed by one of its ends 15A to the destructible element 9 whilst its other end 15B is arranged to be able to slide in a sealed manner along said destructible element 9.

The means 17 arranged to cause the expansion can comprise an annular chamber 19, between the annular sleeve 15 and the destructible element 9, means 21 for supplying this annular chamber 19 with fluid, and blocking-up means 23, in particular a ball and spring valve 23, arranged to selectively block up in the annular chamber 19 the fluid which has been supplied thereto.

Other appropriate selective fixing means 13, different from those described, can be used for implementing the invention.

Preferably, the detachable fixing between the destructible element 9 and the bit 3 is arranged to be detached by relative rotation of the bit 3 with respect to the destructible element 9 previously fixed to said wall.

Figure 3:
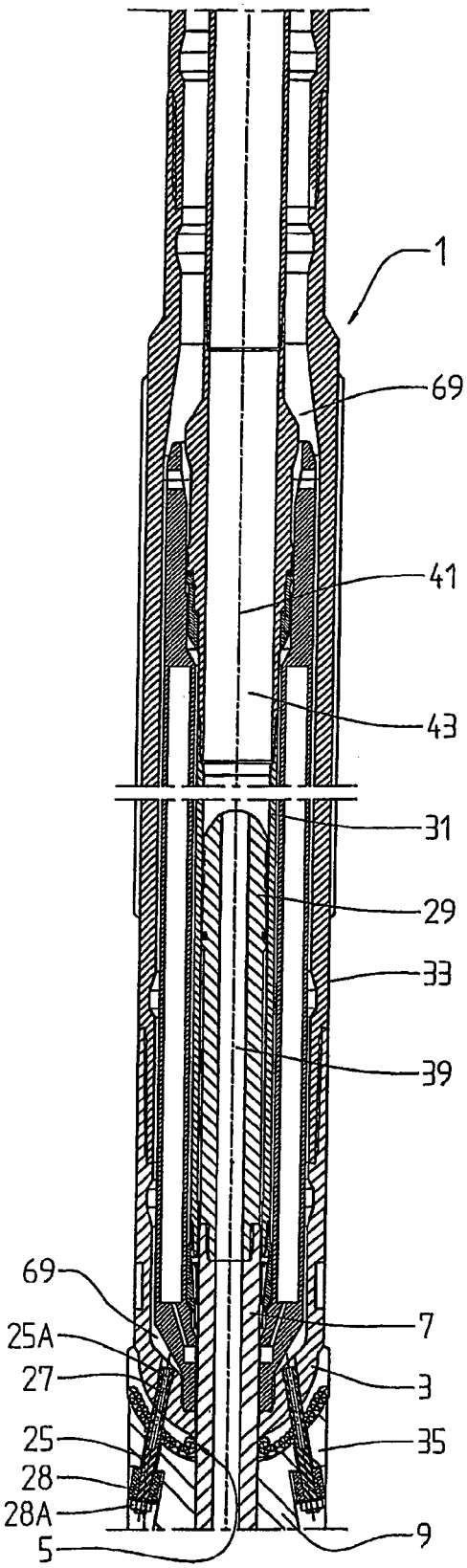

To that end, said detachable fixing between the destructible element 9 and the bit 3 can comprise at least one and preferably several rods 25 fixed each time through a nozzle 27, of the bit 3, provided as a coring fluid outlet on the front face of the bit 3. This rod 25 is advantageously partially tubular and open at its end turned towards the inside of the bit 3, its internal hollow extending as far as beyond the nozzle 27 towards the outside of the bit 3. The rod 25 is closed at its end outside the bit 3. It is arranged to break, during said relative rotation, between the bit 3 and the destructible element 9, in the place where it is hollow, and it is preferably made of a material that can be removed, for example by wear, by coring fluid passing in the broken tubular rod 25 and/or the corresponding nozzle 27. In the example of FIGS. 2 and 3, the rod 25 comprises a thickening 25A at its end inside the bit 3, so as to be wedged in the nozzle 27 when it is driven therein in order to come out thereof outside the bit 3 and go into the destructible element 9. At its other end, the rod 25 can receive a washer made of elastic material 28 and a nut 28A for locking the destructible element 9 on the bit 3. The rod 25 can be produced in particular from synthetic material, aluminium or an alloy thereof.

The rods 25 which are used for the detachable fixing between the bit 3 and the destructible element 9 thus plug all the nozzles 27 in the present embodiment of the invention.

According to this first embodiment of the invention, depicted in FIGS. 1 to 4, said guidance means 11 is the aforementioned internal guide 7 fixed in the destructible element 9.

In the example case of FIG. 3, the internal guide 7 comprises a rear end 29 inserted coaxially in an inner tube 31 of the core barrel 1, which is mounted in a known manner in an outer tube 33 of this same core barrel 1. The internal guide 7 passes through the inner gauge bore 5 and (FIGS. 3 and 2) continues first coaxially into the rear end 35 of the destructible element 9 and next in a curved manner in the direction of, and up to, the lateral surface 37 of the destructible element 9 where the internal guide 7 is fashioned preferably in order to fit into the external shape of said lateral surface 37. The rear end 29 of the internal guide 7 and at least part thereof are pierced by a longitudinal channel 39 preferably with the same axis as the longitudinal axis 41 of the core barrel 1 and of the destructible element 9, this longitudinal channel 39 being continued in this same direction as far as the valve 23 of the means 13 for fixing to the wall of the bore hole. As shown in FIG. 2, the longitudinal channel 39 thus progressively comes out of the internal guide 7 and leaves it owing to the curvature thereof and the straight line of said channel 39. In particular to that end, said longitudinal channel 39 can be drilled in the internal guide 7 and destructible element 9 assembled previously.

The outer 33 and inner 31 tubes are each usually formed from several successive sections fixed to one another in a known manner.

The internal space 43 (FIG. 4) of the inner tube 31 can advantageously comprise a piston system 45 which, in a sealed manner, separates this internal space 43 into an upper space 47, into which coring fluid can be conveyed at controlled pressure from the ground surface, and a lower space 49 in which a different particular fluid can be enclosed before lowering the core barrel 1 into the bore hole. This particular fluid can be a core protection fluid, which can be used, as explained hereinafter, to inflate the annular sleeve 15. To that end, this particular fluid preferably does not comprise any particles which might hamper the correct operation of the valve 23 in particular.

Figure 4:
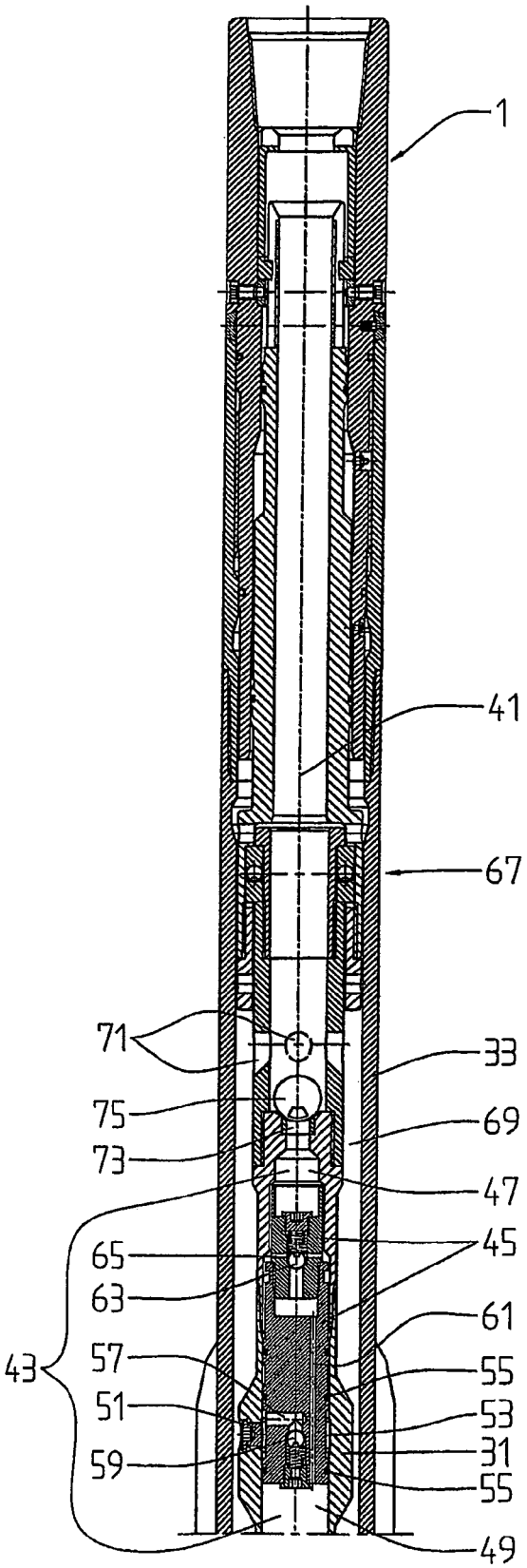

For introducing the particular fluid into the lower space 49 when the piston system 45 is in the position depicted in FIG. 4, there can be provided

- through the wall of the inner tube 31, a passage provided with a plug 51;
- over the periphery of the piston 45, an annular clearance 53 delimited by two O-rings 55 and by said wall of the inner tube 31;
- in the piston 45, a transverse passage 57 between this annular clearance 53 and a ball and spring valve 59;
- a fluid outlet from the valve 59 to the lower space 49;
- in the piston 45, a longitudinal passage 61 between the lower space 49 and a ball and spring valve 63 intended for draining surplus particular fluid; and
- an outlet 65 for the fluid from the valve 63 to the inner space 43 and more particularly to its upper space 47.

This particular fluid is introduced by this path into said lower space 49 before putting the inner tube 31 into the outer tube 33.

The inner tube 31 is suspended in a known manner in the outer tube 33 using a ball thrust bearing system 67 (FIG. 4).

Coring fluid can be conveyed through the thrust bearing system 67 and can flow to the gap 69 between the outer 33 and inner 31 tubes through orifices 71 and to the top of the piston 45 through an orifice 73 as long as the latter has not been closed off by a ball 75.

A first embodiment of the method of the invention can be described with the help of the device of the invention according to the embodiment described above, without however being limited to the use of this device.

Besides usual selection, according to the work to be carried out, of a core barrel 1 provided with a core bit 3, there is arranged in the core barrel 1 an internal guide 7 of the kind described which, before beginning a deviated coring, is arranged inside at least said inner gauge bore 5, so that the bit 3 can move along this internal guide 7. The latter is disposed so as to extend in front of the bit 3, according to a forward direction of coring thereof, and is arranged to progressively deviate the bit 3 from said longitudinal direction of the bore hole towards the wall thereof.

The internal guide 7 is kept fixed with respect to the wall of the bore hole in order to give the bit 3 a desired deviated path direction. The coring is started up with said bit 3 thus equipped and there is allowed to be carried out a guidance of the bit 3 by its inner gauge bore 5 along the internal guide 7, until said wall and the formation are penetrated to a desired depth following the deviated path.

In a variant of the method of the invention, in order to fix the position of the internal guide 7 with respect to said wall of the bore hole, there is advantageously fixed in a detachable manner to the bit 3, in front thereof according to its forward direction of coring, the above-mentioned destructible element 9, in particular using the described rods 25.

There is then fixed in this destructible element 9 a guidance means arranged to give the deviated path direction.

In particular, the above-mentioned internal guide 7 can be used directly as the guidance means 11 in the destructible element 9 or vice versa, the internal guide 7 and the guidance means 11 being merged in one component.

The aforementioned particular fluid may be introduced into the internal space 43 only when the destructible element 9 and the internal guide 7 are fixed to the core barrel 1, so as to also fill the longitudinal channel 39 up to at least the valve 23, and preferably right into the annular chamber 19, flushing out the air therein.

The core barrel 1 can then be lowered into the bore hole and the destructible element 9 fixed to the wall of the bore hole at a location chosen for a deviated coring. To that end, drilling fluid sent under pressure into the core barrel 1, not being able to flow through the nozzles 27 plugged by the rods 25, is forced to pass through the orifice 73 and act on the face of the piston 45 which it encounters in the upper space 47. The piston 45 thus acted on pushes the particular fluid through the longitudinal channel 39 so that this fluid opens the valve 23 and passes, through holes 24, into the annular chamber 19 in order to fill it and thus push the annular sleeve 15 into a contact of the closest kind with the wall of the bore hole. This locks in the bore hole the destructible element 9 and the core barrel 1 which is fixed thereto. When the pressure of the coring fluid is reduced or nullified temporarily, the piston 45 releases the pressure of the particular fluid and the valve 23 is closed again by the action of its spring and possibly by a reverse pressure caused by the annular sleeve 15. The annular chamber 19 thus remains full and the annular sleeve 15 remains in locking contact in order to keep the position of the destructible element 9 fixed translation-wise and rotation-wise in the bore hole.

So that the pressure of the coring fluid no longer acts on the piston 45, there can advantageously be sent into the core barrel 1, as is known, a closure ball 75 (FIG. 4) sized to reach as far as the orifice 73 and close the latter up.

As the destructible element 9 is thus fixed in the bore hole, when the bit 3 is set rotating by means of the outer tube 33, the rods 25 are caused to break. The coring fluid can now pass through the tubular part of each rod 25 remaining in its respective nozzle 27, and by abrasion wear this tubular part until said nozzle 27 is freed sufficiently or totally.

It is then necessary to continue the rotation of the bit 3 and push it forward so that it follows the deviated path given by the internal guide 7 thus fixed to the wall of the bore hole, destroying the part of the destructible element 9 which it encounters and penetrating said wall and the formation to a desired depth.

Said particular fluid remaining in the inner space 43 or more precisely in the lower space 49 can be used, if it has been chosen for that purpose, to coat the core as it enters this lower space 49, the surplus of this fluid being able to escape for example through the valve 63 and, by pushing back the ball 75, mix with the coring fluid in the gap 69.

It should be understood that the curve that can be given to the internal guide 7 has a very large radius, and that consequently the length of this internal guide 7 is large, since the deviation that the latter can give to the core barrel 1 is small owing to the rigidity thereof. At the time of selection of the core barrel 1, this length will therefore be taken into account in calculation of the length of the inner space 43 in which the internal guide 7 will enter and remain. To that end, the internal guide 7 can advantageously have, outside the destructible element 9, a certain flexibility so as to be able to straighten somewhat when it reaches and is located in the inner tube 31.

In FIG. 2, it can be seen that the internal guide 7 emerges, from inside the destructible element 9 to the lateral surface thereof, between two stabilizing wings 77. It could just as easily emerge through one such wing 77.

It is apparent that, for example, the front part of the destructible element 9, which carries the means 13 (sleeve 15) of fixing to the wall, remains practically in place in the bore hole when the core barrel 1 is withdrawn after the deviated coring. This part, wedge-shaped by the action of the bit 3, can therefore serve as a guide for reintroducing, following the same deviation, the same core barrel 1 or another or even a drilling device. This same wedge-shaped front part can however subsequently be detached from the wall and/or destroyed in order to make it possible to carry out a deviated coring and/or drilling operation at a deeper level in the same initial bore hole.

Figure 6:
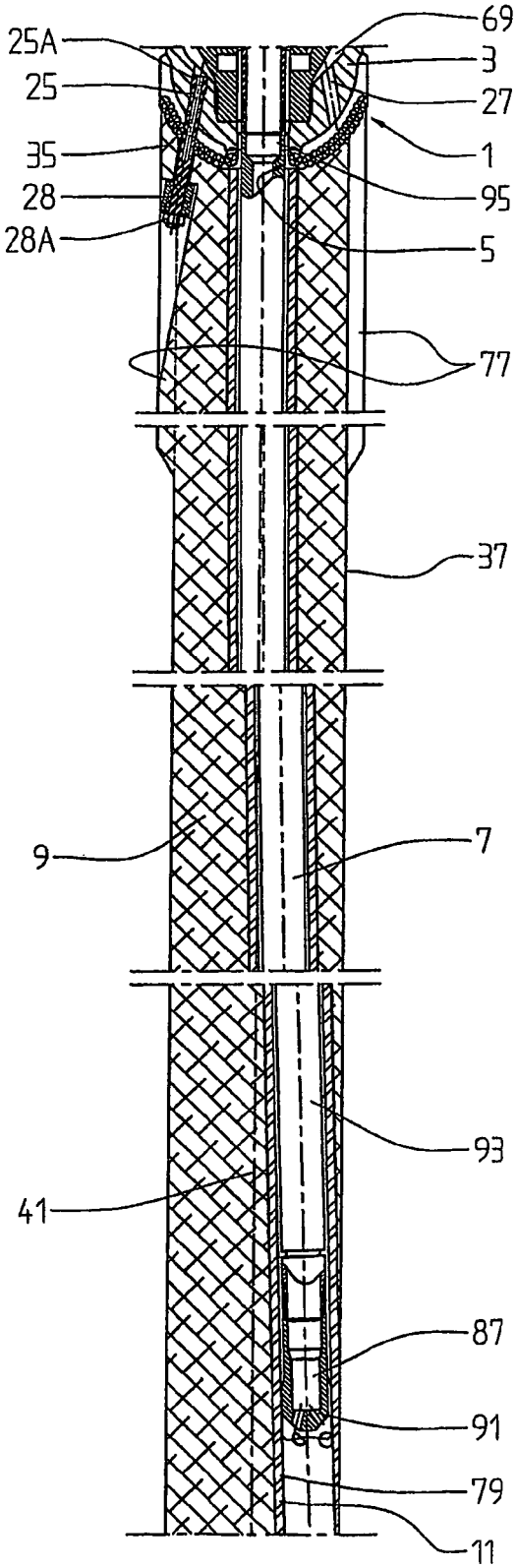
Figure 5:
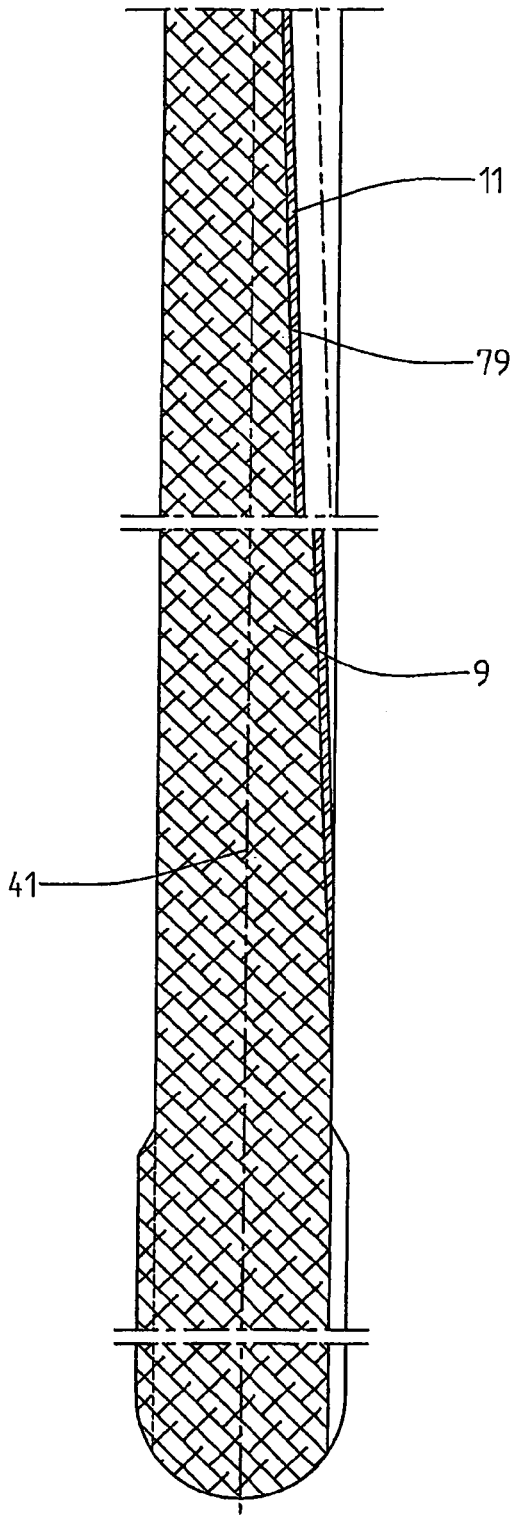
Figure 8:
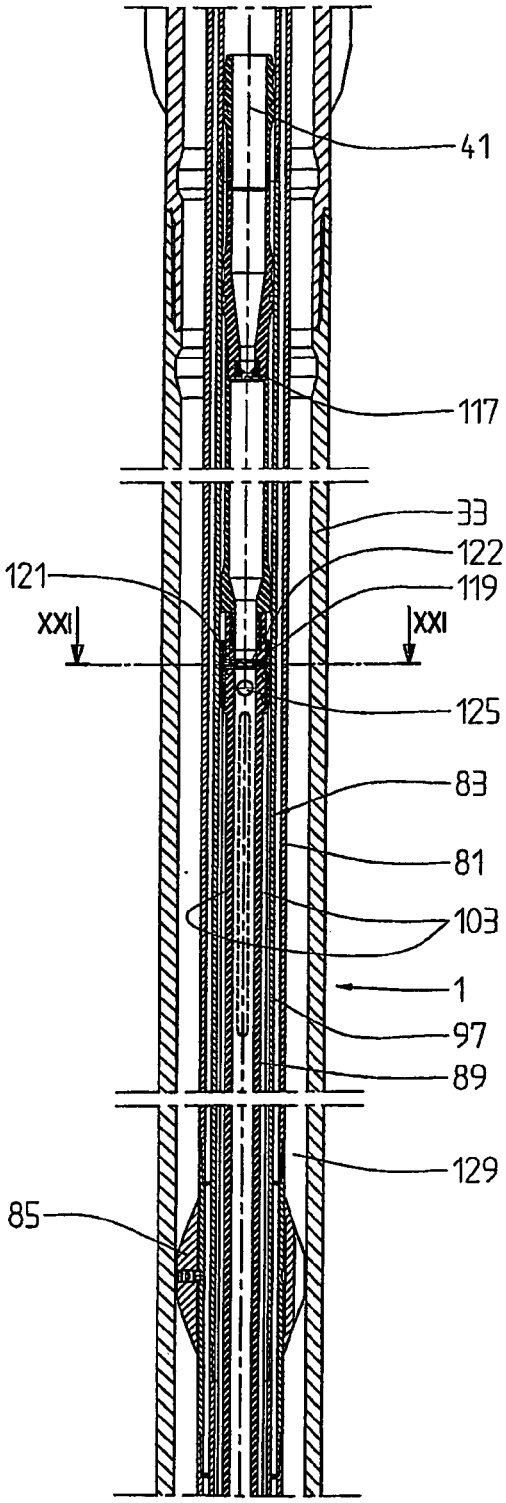
Figure 7:
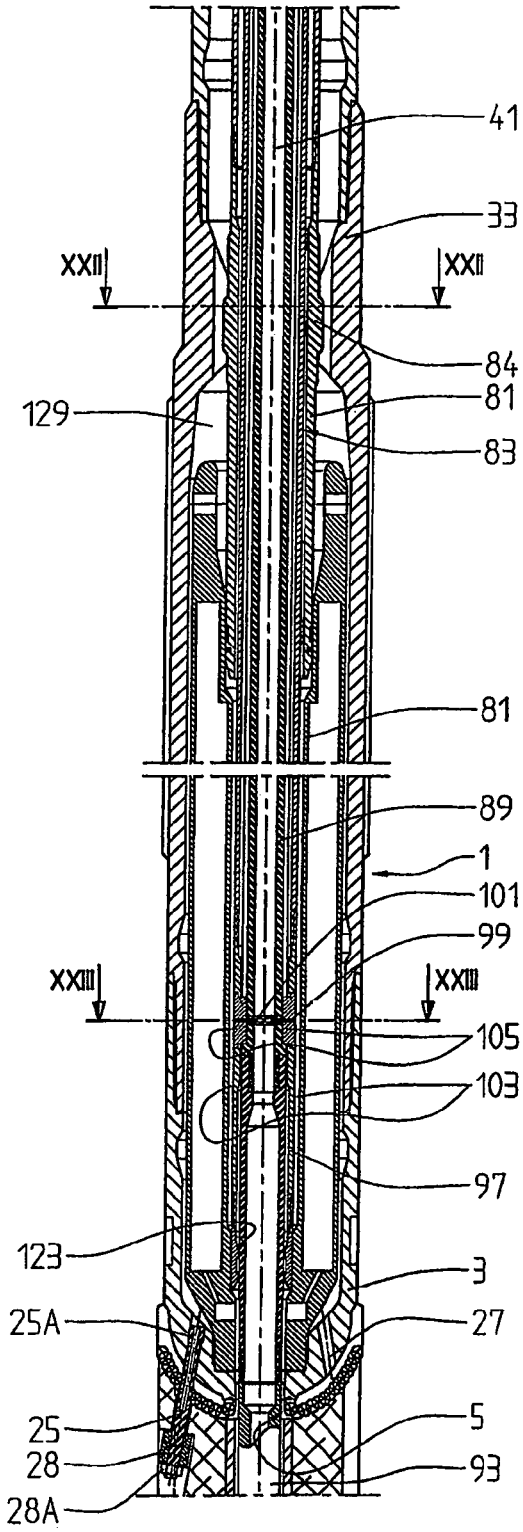
Figure 10:
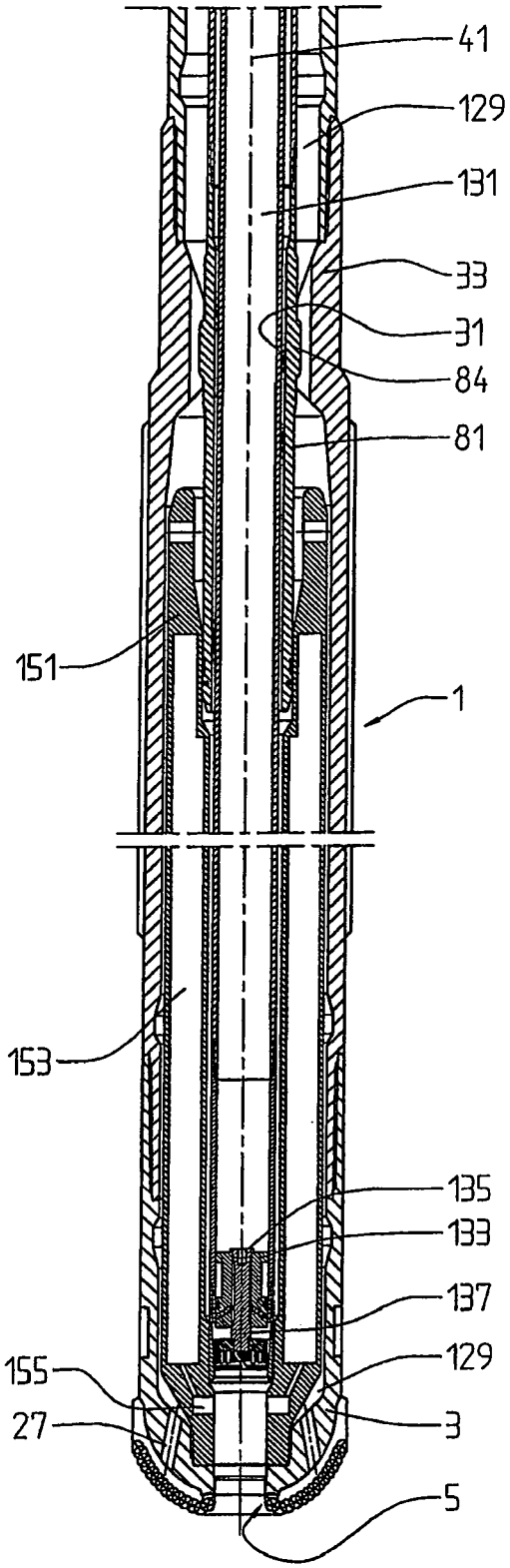
Figure 9:
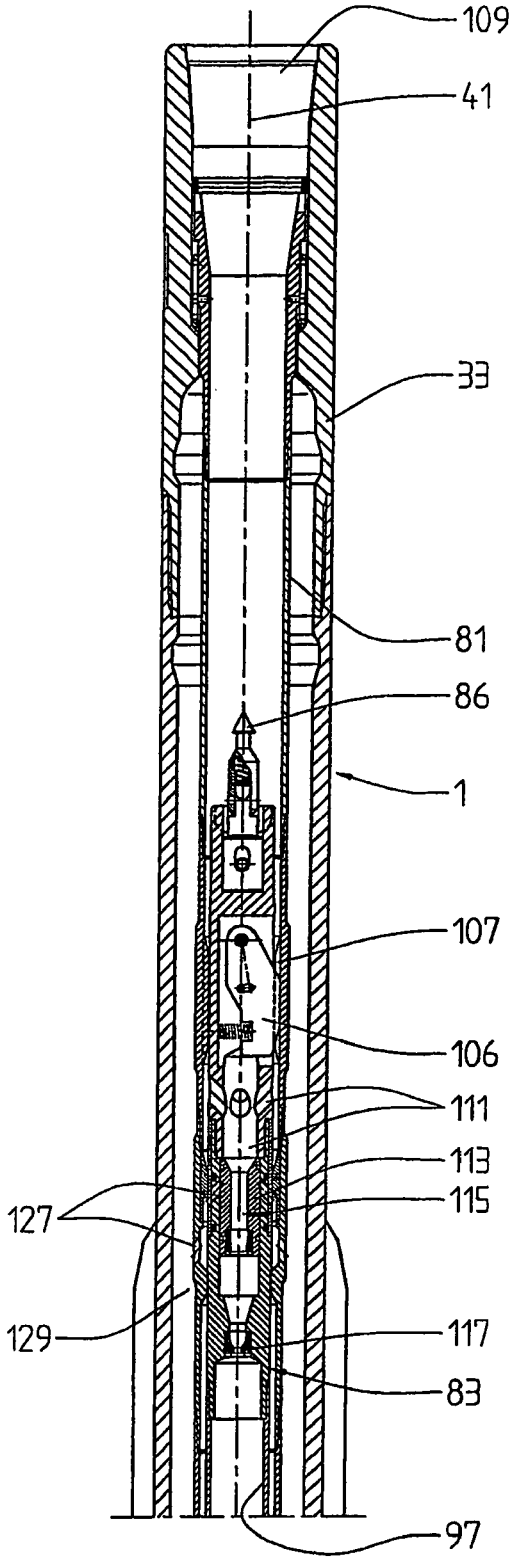
Figure 12:
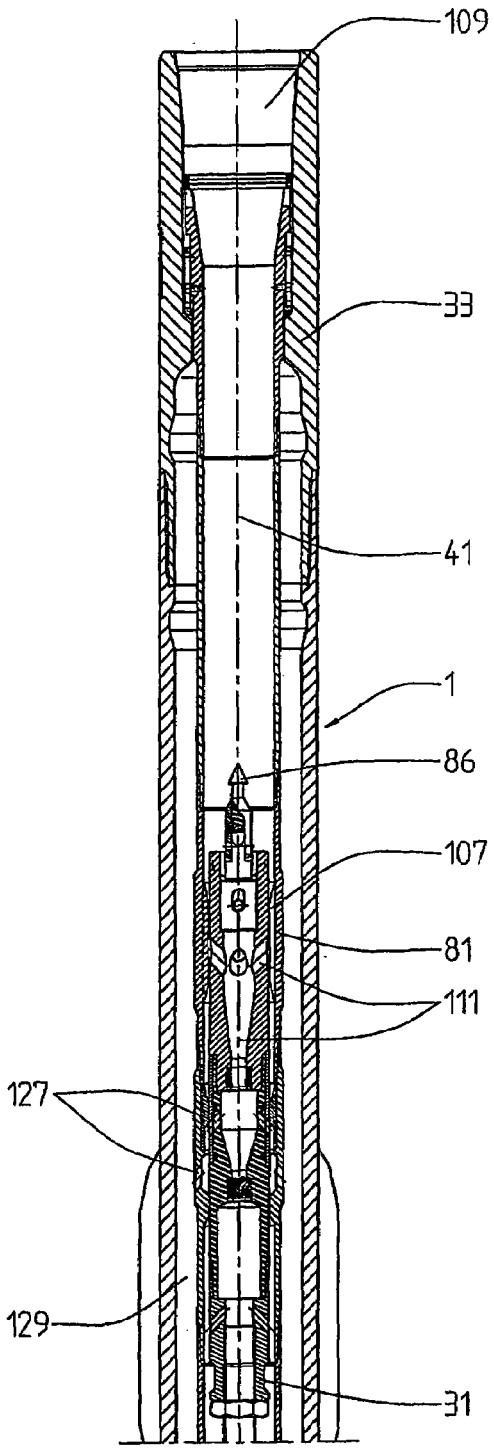
Figure 11:
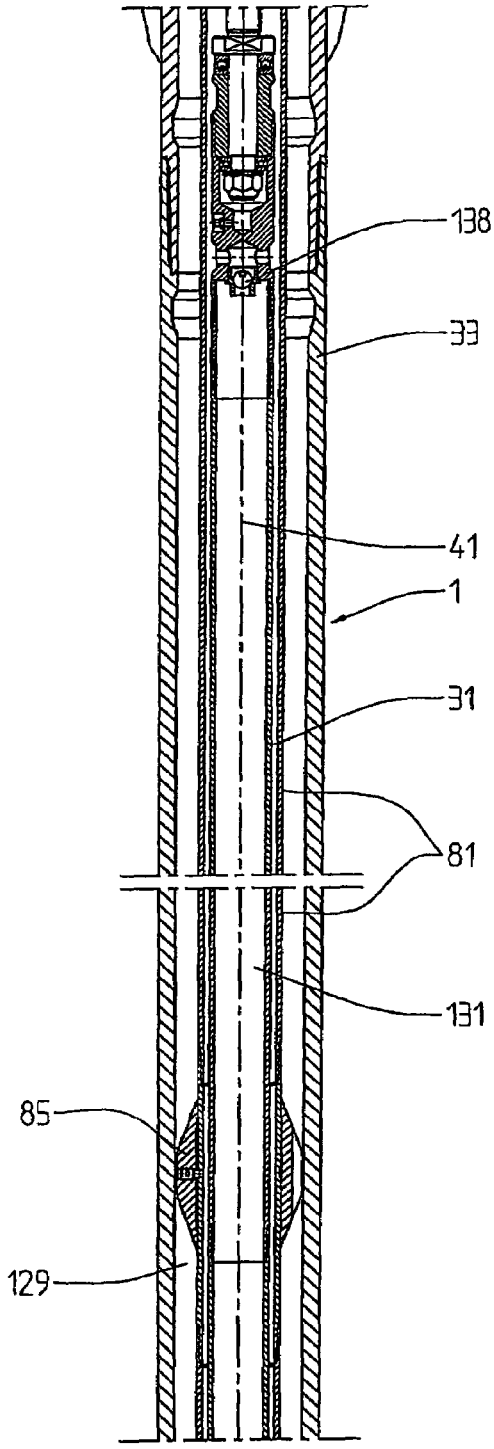

In a second embodiment of the invention (FIGS. 5 to 12 and 21 to 23), said guidance means 11, fashioned in the destructible element 9, is a guidance channel 79, in particular of cylindrical tubular shape, one end of which is substantially coaxial with the inner gauge bore 5 of the bit 3 and whose line corresponds to the desired deviated path, in order to emerge, cut on a slant, from the lateral surface of the destructible element 9, as depicted in FIGS. 5 and 6, so as not to extend beyond this lateral surface.

In this second embodiment of the invention, an intermediate guidance tube 81 can be arranged in the outer tube 33, in order to temporarily house therein, on the one hand, a removable assembly 83 comprising the internal guide 7 which will cause the desired deviation and, on the other hand, next an inner tube 31 which will subsequently receive a core. A toothed coupling (FIGS. 7 and 22) can be provided between the intermediate 81 and outer 33 tubes in order to immobilize them as regards their rotation. The passages for the fluid, formed between the teeth carried by the intermediate tube 81 and the bottoms of the hollows between the teeth of the outer tube 33, should be noted. The intermediate tube 81 can comprise known centering means 85 (FIGS. 8 and 11), having longitudinal passages for fluid. The removable assembly 83 comprises, in order to be able to withdraw it from the core barrel 1 (FIG. 9), a coupling stud 86.

The internal guide 7 proper comprises for its part a drilling machine 87 (FIG. 6) carried by a drilling string 89 (FIGS. 7 and 8), and is arranged in order to be conveyed through the core barrel 1, in the intermediate tube 81, through the inner gauge bore 5 and, following the guidance channel 79, so as to be able to drill and penetrate the wall of the bore hole according to said deviated path given by the guidance channel 79. The drilling string 89 has a length chosen so that, when the drilling machine 87 is driven into said wall according to a chosen anchorage depth, the drilling string 89 is still engaged in at least the inner gauge bore 5. For example, the drilling machine 87 comprises a drill head 91 and, for turning the latter, a hydraulic motor 93 known per se, supplied with drilling fluid at its rear end 95, through the hollow drilling string 89, from the outer tube 33.

Figure 1:
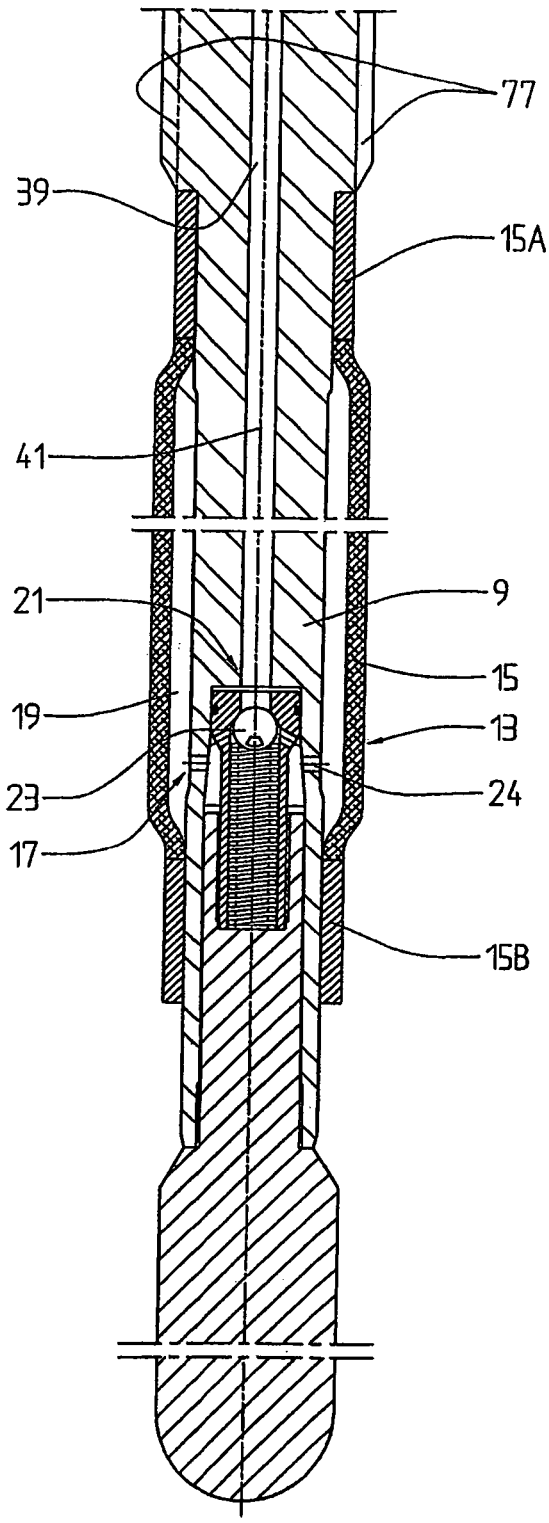

In the case being described at present, the destructible element 9 (FIGS. 5 and 6) is not equipped with the means 13 depicted in FIG. 1 (and described above) for selective fixing to the wall of the bore hole, and this means is not necessary in said second embodiment. For this reason, it is not necessary to close up all the nozzles 27 with rods 25 (FIG. 6).

In the case of the second embodiment, the removable assembly 83, which is proposed by way of example for manipulating the internal guide 7 in the intermediate tube 81, can comprise a removable tube 97 arranged to slide in the intermediate tube 81 and in which the drilling string 89 of the drilling machine 87 is housed.

The method associated with said second embodiment can then comprise arrangement, as the guidance means 11 in the destructible element 9, of the guidance channel 79 disposed as explained above.

There is disposed, for example at the assembling of the core barrel 1, the drilling machine 87, carried by its drilling string 89, through the core barrel 1 and the inner gauge bore 5, so that it follows the guidance channel 79, preferably so that the drill head 91 is positioned (as depicted in FIG. 6) at a still laterally closed-off location of said guidance channel 79 but close to the front end thereof.

To that end, the drilling string 89 from which the drilling machine 87 is suspended is held by a breakable pin 99 (FIGS. 7 and 23) which passes through the drilling string 89 in a transverse sealing tube 101 which is fixed thereto in a sealed manner. The breakable pin 99 can be held either side in the removable tube 97 which is disposed (indirectly) abutting against the inside of the bit 3. The body of the motor 93 is prevented from turning by its fixing to the drilling string 89 which, in the example implementation, comprises on its external surface two longitudinal grooves 103 cooperating with two internal protuberances 105 of the removable tube 97. The removable tube 97 itself is prevented from turning for example by a spring catch 106 (FIG. 9) which it comprises and which cooperates to that end with a longitudinal groove 107 cut in the intermediate tube 81 locked rotationally for its part, by the toothed coupling 84, in the outer tube 33 which does not turn during this phase of the operation.

Drilling or coring fluid is sent under pressure into the core barrel 1 from its rear end 109 (FIG. 9) and passes into the intermediate tube 81 which it pushes at the same time into abutment (directly or indirectly) against the bit 3. This fluid passes along the coupling stud 86 and the spring catch 106, through passages 111, and through a selector piston 113 held by a breakable pin 115 in a position drawn in FIG. 9. From there, the fluid flows through a nozzle 117 and inside the removable tube 97 and (FIG. 8) reaches the rear end of the drilling string 89 which is arranged as a kind of piston in the removable tube 97 and is provided with a nozzle 117 for restricting the passage of the fluid. By its pressure, said fluid pushes on the drilling string 89 and, running along this drilling string 89, reaches (FIG. 7) the motor 93 which it turns in order to turn the drill head 91. The breakable pin 99 is broken under a controlled pressure of the fluid and the drilling machine 87 can then move forward towards the wall of the bore hole.

Thus there is caused a drilling by the machine 87 in the wall of the bore hole according to said deviated path given by the guidance channel 79. The drilling string 89 has a length chosen so that, when the drilling machine 87 is driven into said wall according to a chosen anchorage depth, the drilling string 89 is still engaged in at least the inner gauge bore 5 of the bit 3.

Advantageously (FIGS. 8 and 21), an external sleeve 119 is mounted so as to slide in a sealed manner on the drilling string 89, into a position dependant on the chosen anchorage depth, and is fixed to said drilling string 89, in the drawn position, by a breakable pin 121 which passes through the drilling string 89 in another transverse sealing tube 122 similar to the preceding tube 101. In this position, this external sleeve 119 closes up one or more orifices 125 formed through the wall of the drilling string 89.

When the drilling string 89 has run along in the removable tube 97 the distance chosen for the anchorage, said external sleeve 119 comes to abut (FIG. 7) against a stopping shoulder 123 and, under the force exerted by the pressure of the fluid pushing said drilling string 89, the breakable pin 121 breaks and the drilling string 89 moves forward again, in particular in said sleeve 119 (FIG. 8), by a given length. By means of this movement, the sleeve 119 frees the orifices 125 and that brings down the pressure of the fluid in the core barrel 1. For this reason, the motor 93 no longer has the strength to make the head 91 drill and simultaneously the operator of the core barrel 1 can see the pressure drop on a manometer on the surface and understand thereby that this drilling is finished.

At this stage of the operations with the second embodiment of the invention, the destructible element 9 (FIGS. 5 and 6) is fixed in the bore hole by the drilling machine 87 driven in the manner of a nail into the formation (position not depicted).

For example, at this moment a chosen sudden increase in pressure of the fluid is caused and said pressure acts on the selector piston 113 (FIG. 9) with a force which causes the breaking of its breakable pin 115 and displacement of said selector piston 113 in the chamber it is occupying, in the direction of the bit 3, until a passage is opened for said fluid through the orifices 127 which lead said fluid into the space 129 between the outer 33 and intermediate 81 tubes so that, by this path, this fluid reaches as far as the nozzles 27 in order to be able to start the deviated coring operation proper.

At this moment, it is necessary to cause the breaking of the detachable fixing between the bit 3 and the destructible element 9. To that end in particular, the bit 3 is set rotating by means of the outer tube 33, the destructible element 9 being locked rotationally by the drilling machine 87 embedded in the formation. This breaks the rods 25. Said rotation is kept up and the core barrel 1 is pushed forward, being able to follow only the deviated path given by the drilling string 89 and the drilling machine 87, destroying the part of the destructible element 9 and of said guidance channel 79 which the bit 3 encounters and penetrating said wall and the formation around the bore hole to a desired depth.

At this stage of the operations, the removable assembly 83, and therefore said internal guide 7, formed by the drilling machine 87 and its accessories, can for example be withdrawn by catching hold in a known manner of the coupling stud 86 of this assembly. There can then be introduced into the core barrel 1, more precisely into its intermediate tube 81, a customary inner tube 31 (FIGS. 10 to 12) using a coupling stud 86 thereof.

In the example being described presently, the internal space 131 (FIGS. 10 and 11) of the inner tube 31 can be filled beforehand and in a known manner with another fluid, in particular for protecting the core which will enter therein. The front end (FIG. 10) of this internal space 131 can then be provided with a piston 133 for distributing this other fluid over the periphery of the core. To that end, the piston 133 can comprise a valve 135 whose stem 137 rests on the top of the core at the start of the entry of the latter into the inner tube 31 and whose displacement frees a passage for the fluid through the distribution channels of the piston 133 which emerge towards the top of the core, as the core enters therein.

At the rear end of said internal space 131 (FIG. 11), there can be provided for example a ball 138 disposed in order to make it possible for the other fluid, contained in the internal space 131 and in surplus when the core enters therein, to be able to escape therefrom and to prevent the coring fluid under pressure, coming from outside this internal space 131, from entering therein.

Figure 13:
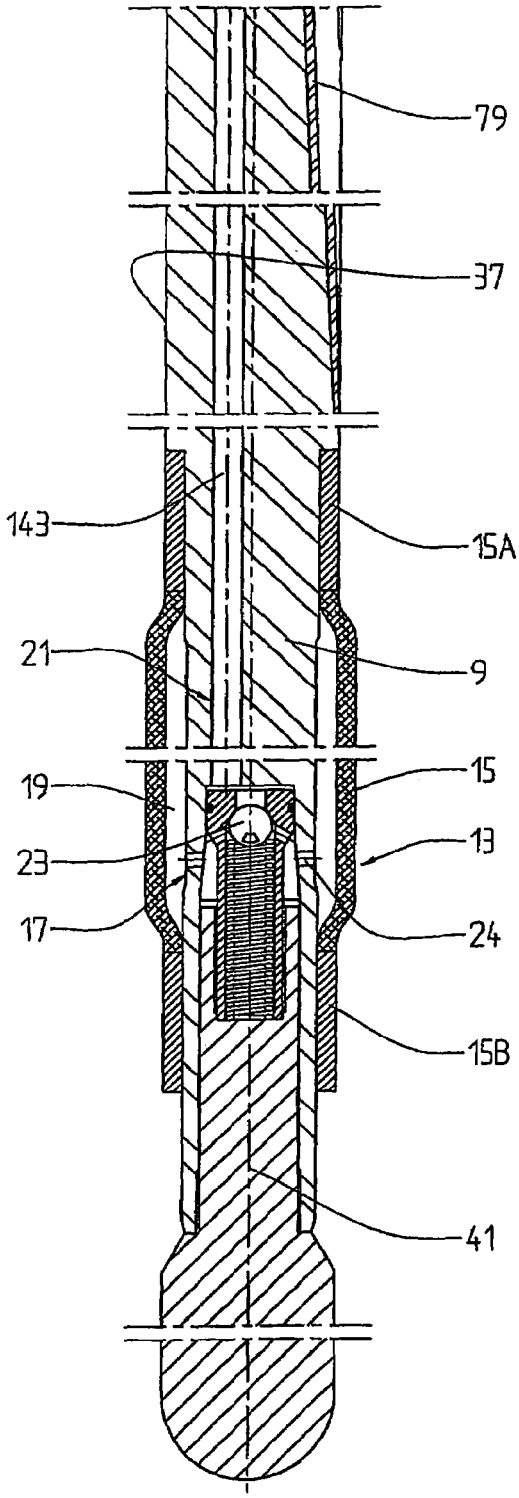
Figure 16:
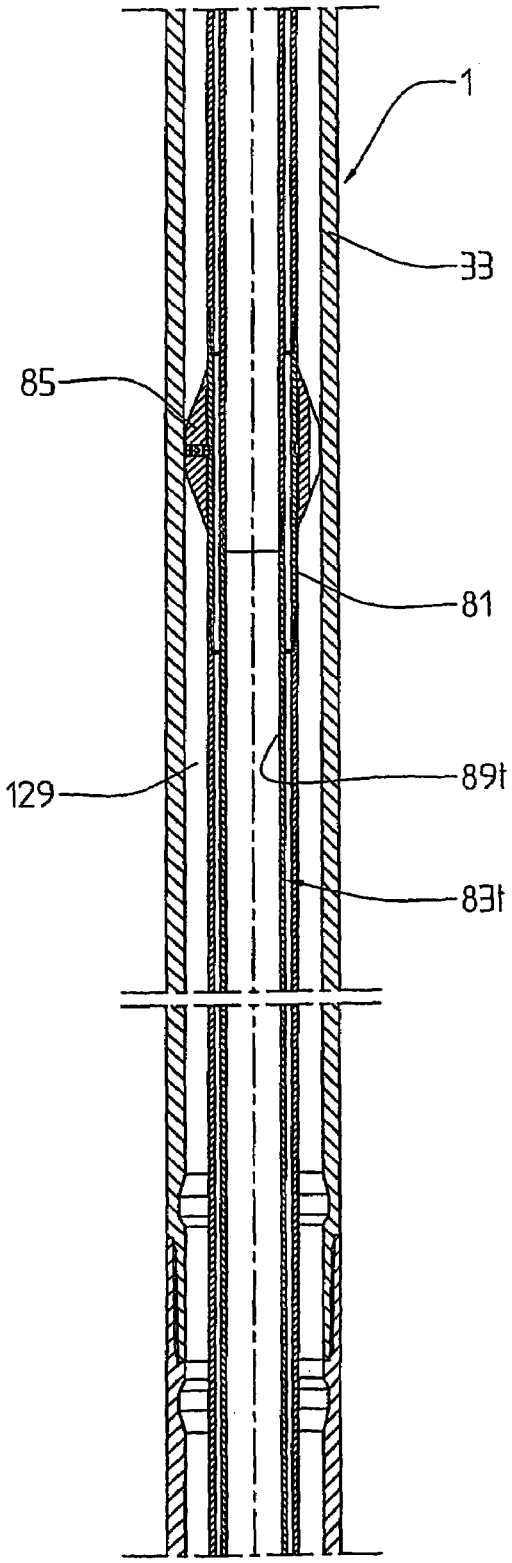
Figure 15:
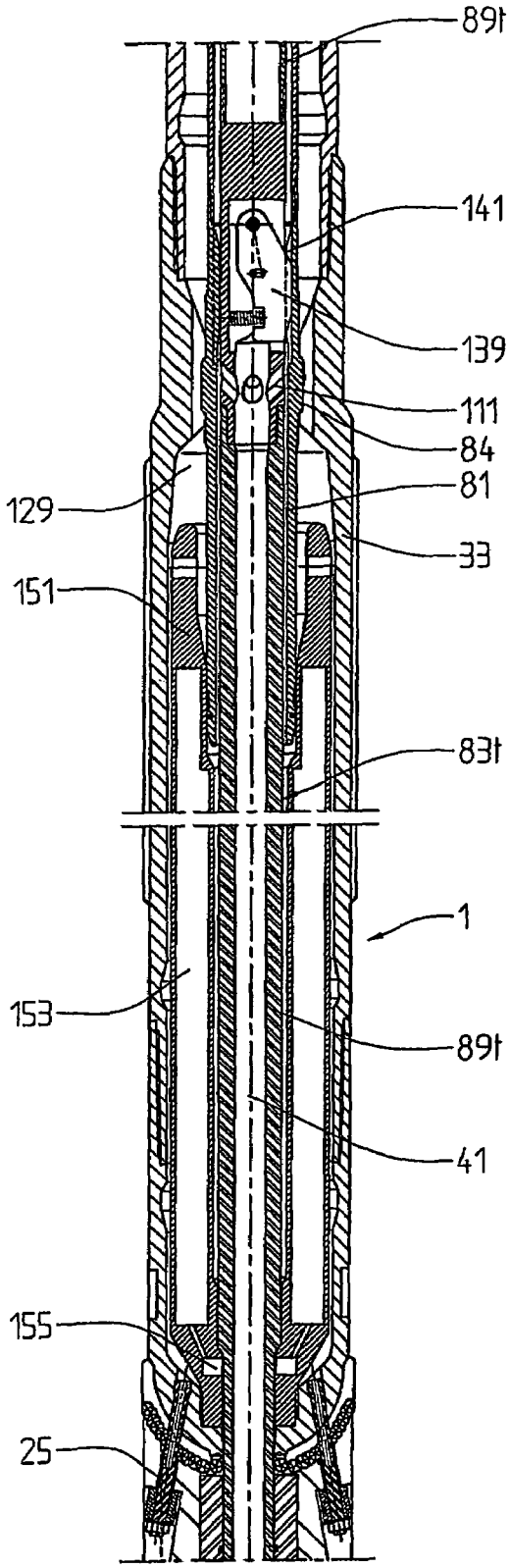
Figure 18:
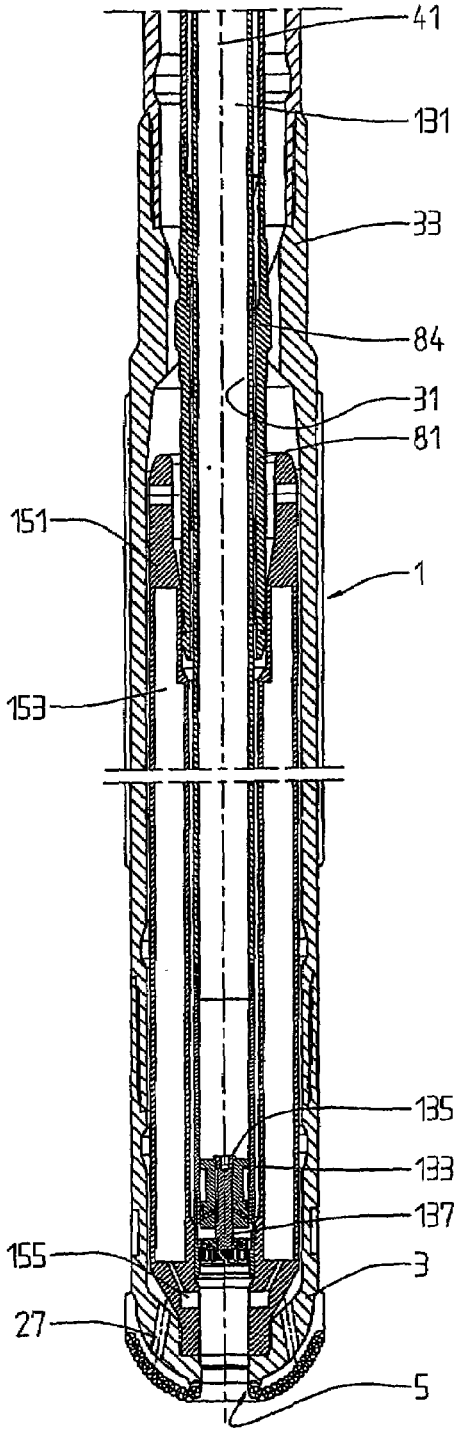
Figure 17:
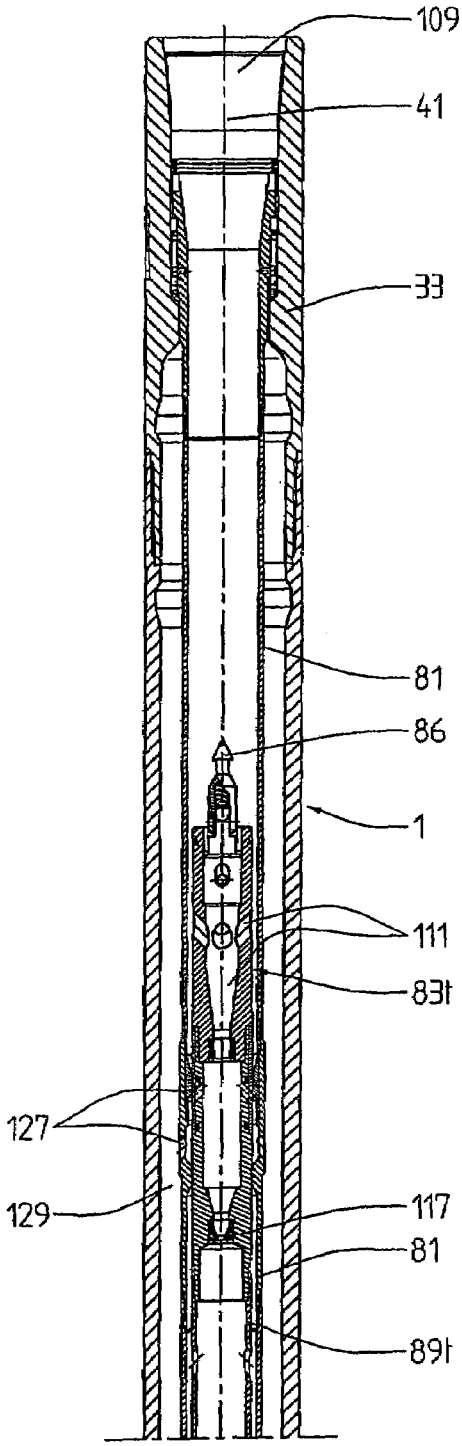
Figure 20:
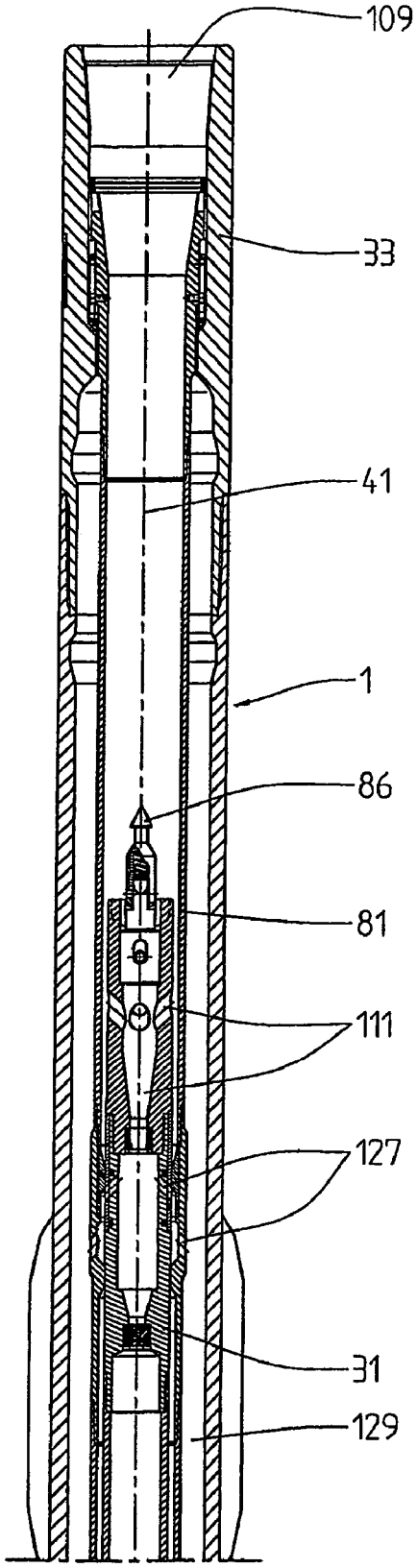
Figure 19:
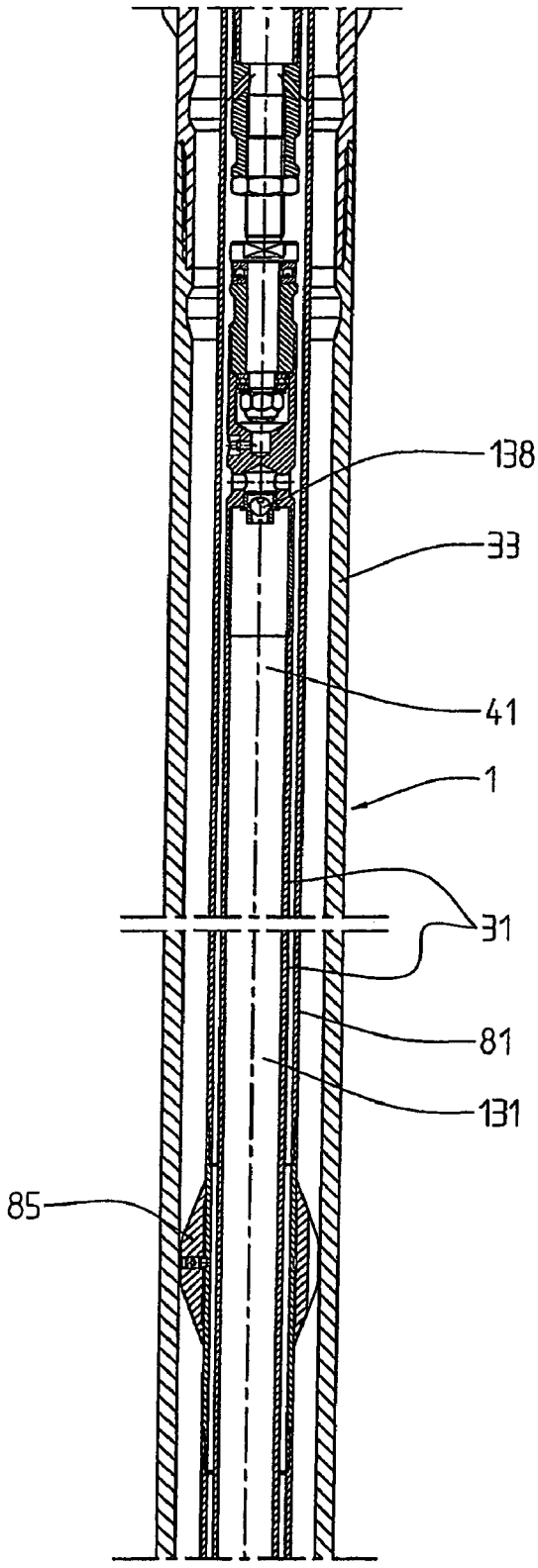
Figure 21:
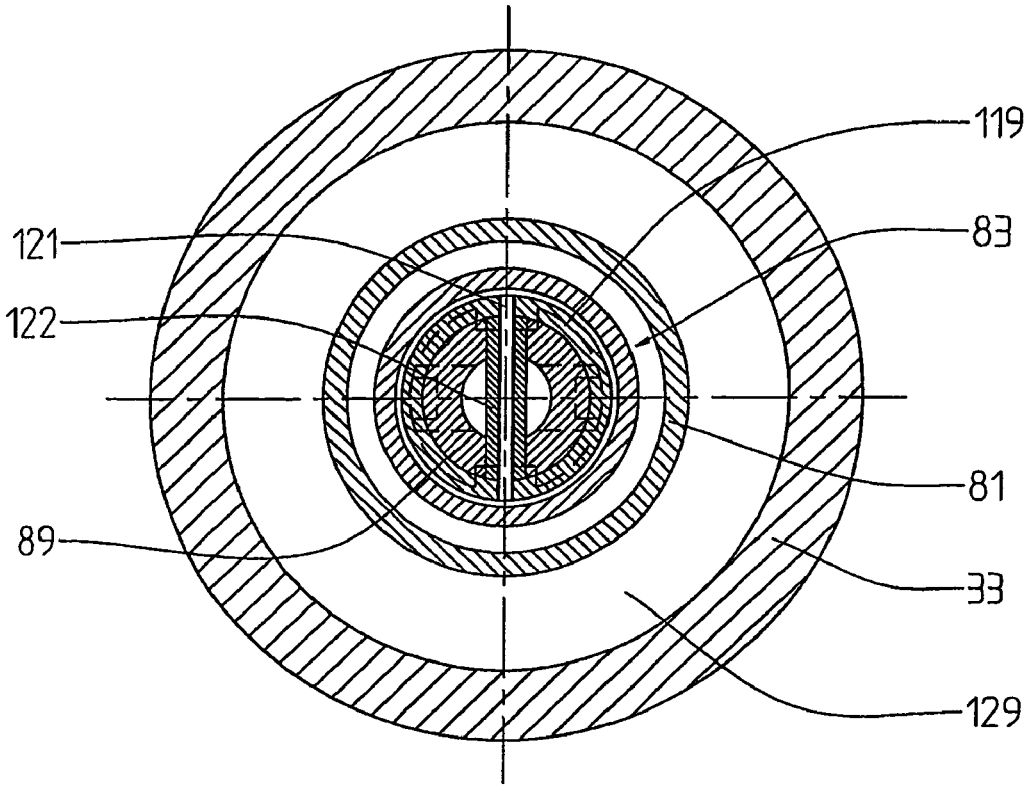
FIGS. 21 to 23 show, at other scales, cross-sections of constructional details, taken respectively in the sectional planes XXI—XXI of FIG. 8, XXII—XXII of FIG. 7 and XXIII—XXIII of this same FIG. 7.
Figure 22:
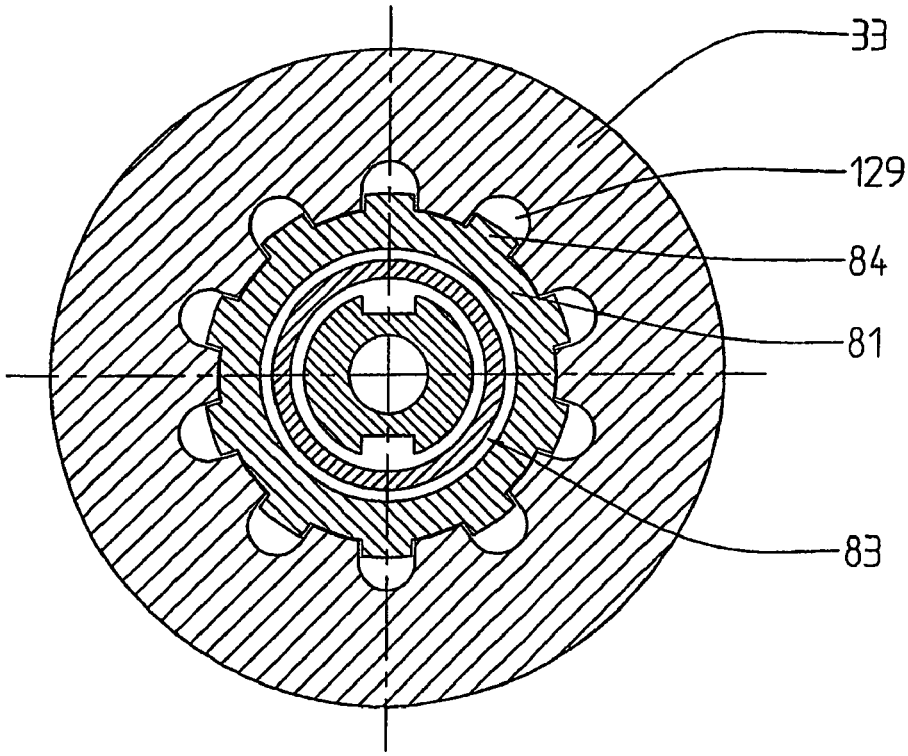
Figure 23:
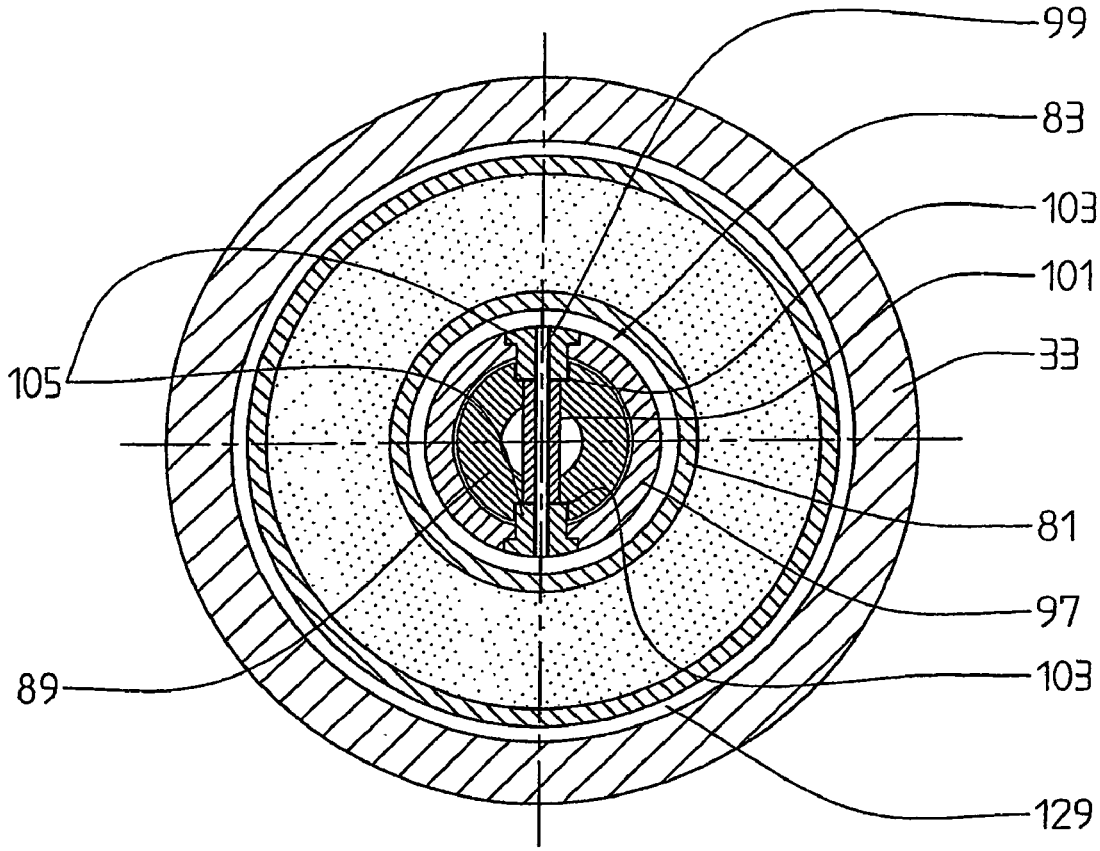

In a third embodiment (FIGS. 13 to 20) of the device of the invention, said guidance means 11 (FIGS. 13 and 14), in the destructible element 9, is also a guidance channel 79, one end of which is substantially coaxial with the inner gauge bore 5 of the bit 3, and whose line corresponds to the desired deviated path. The internal guide 7 also comprises a drilling machine **87*t* carried by a drilling string 89*t* and arranged through the core barrel 1 and the inner gauge bore 5 and following the guidance channel 79 in the direction of said wall. The drilling machine 87*t* and its drilling string 89*t* are mounted in the core barrel 1 so that said machine 87***t* projects by a given distance outside the bit 3 into the guidance channel 79. The drill head 91*t* of the machine 87*t* could also be driven rotationally by a motor as in the second embodiment.

However, in the example of FIGS. 14 to 17, said drill head 91*t* does not comprise a motor but is coupled by the drilling string 89*t* to the bit 3 of the core barrel 1 as explained hereinafter.

To that end, the drilling machine 87*t* and its drilling string 89*t* form a removable assembly 83*t* which is installed in the intermediate tube 81 in order to come directly or indirectly into abutment against a stop in the bit 3, so that the drill head 91*t* is at the desired distance in front of the bit 3. A spring catch 139 (FIG. 15), which forms part of the removable assembly 83*t*, engages in a longitudinal groove 141 cut in the intermediate tube 81 so that the latter, when driven rotationally by the outer tube 33 via the toothed coupling 84, rotationally drives the removable assembly 83*t* and therefore the drill head 91*t* which forms part thereof and is also fixed thereto for rotation.

In the case being described presently, since the bit 3 must turn in order to provide the rotation of the drill head 91*t*, it is consequently necessary to fix the destructible element 9 (FIGS. 13 and 14) to the wall of the bore hole, for example with the same elements, such as the inflatable annular sleeve 15 and its accessories, and in the same way as in the case of the first embodiment.

Figure 14:
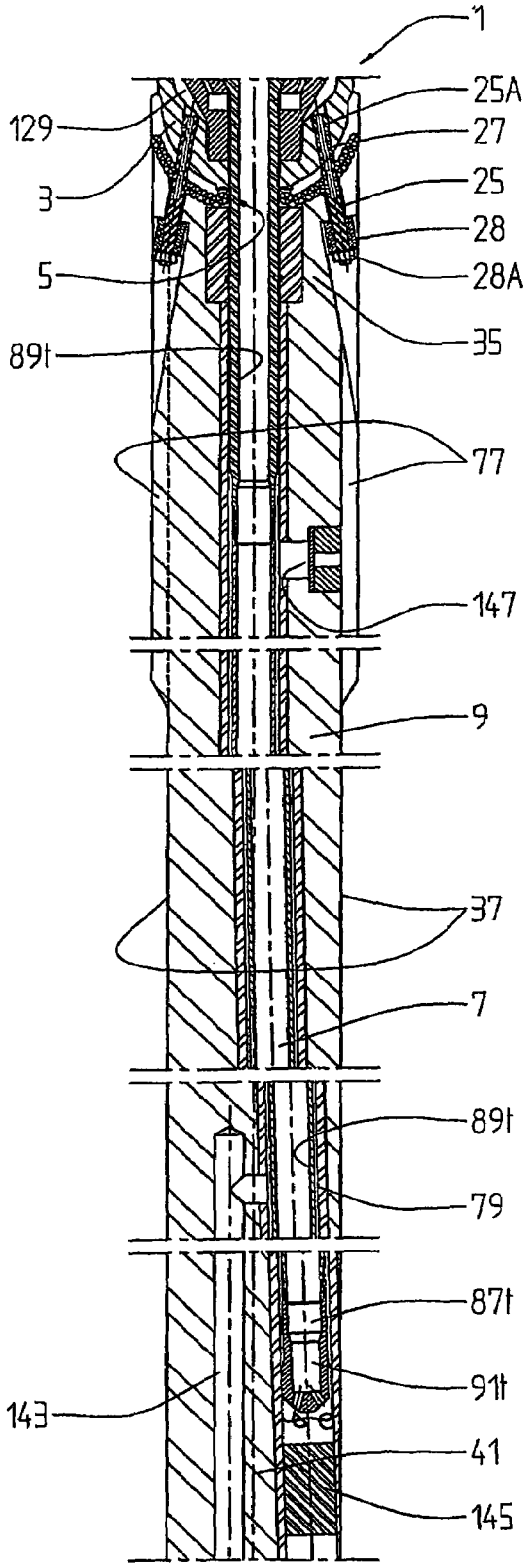

In order to convey inflation fluid to the sleeve 15, the supply means 21 (FIGS. 13 to 15) can comprise, besides the valve 23 and the passage holes 24 described previously in the first embodiment, a duct 143 arranged parallel to the longitudinal axis 41 and connecting, for the fluid, the inside of the guidance channel 79 to the valve 23. So that said inflation fluid passes into this duct 143 at the desired moment, the guidance channel 79 is closed off by a hermetic plug 145 disposed temporarily in front of the drill head 91*t* (FIG. 14).

The method of the invention, applied within the context of this third embodiment of the core barrel 1, can comprise the following steps, certain of which are essential to the invention and others of which are necessary only for understanding (as is also the case for the other embodiments).

There is mounted for example a core barrel 1 like the one depicted in FIGS. 13 to 17 and there is arranged, as the guidance means 11 in the destructible element 9, the guidance channel 79 disposed as explained above. During this mounting, there is arranged in particular the drilling machine 87*t*, carried by the drilling string 89*t*, through the core barrel 1 and the inner gauge bore 5 and following the guidance channel 79 in the direction of said wall to be drilled. The drilling machine 87*t* is fixed to the core barrel 1, in order that it projects by a given distance outside the bit 3 into the guidance channel 79. This fixing will presently be the result of the pressure of the drilling/coring fluid on the removable assembly 83*t*, pushing the latter into abutment against the inside of the bit 3.

There can then be poured into the intermediate tube 81 a fluid, preferably particular fluid, with no particles in order to not impede the correct operation of the valve 23, so that a sufficient quantity of this fluid is stored in the duct 143, the guidance channel 79 being closed off by the plug 145, and the drilling string 89*t* in order to subsequently provide correct inflation of the sleeve 15.

The core barrel 1 can then be lowered into the bore hole and positioned at the location where the deviated coring is desired. Fixing of the destructible element 9 to said wall of the bore hole is next caused, as already described, by inflation of the sleeve 15 using the particular fluid subjected to sufficient pressure sent into the core barrel 1 from the derrick, in particular using a coring/drilling fluid pressing on the particular fluid.

It is necessary to cause, at this moment, breaking of the detachable fixing between the bit 3 and the destructible element 9. To that end, in the present case the bit 3 is set rotating and, the destructible element 9 being locked by the fixing means 13 in the bore hole, the rods 25 break. It should be noted that, in order to be able to pressurize the fluids, all the nozzles have been plugged by rods 25 of the type described above.

It is possible to continue the rotating of the bit 3 and push it forward through the destructible element 9 which it destroys on its passage, at the same time as the guidance channel 79 which is located there. In its travel, the bit 3 drives the drilling machine 87*t* which precedes it, the coring/drilling fluid pressing the drilling string 89*t* towards the front. The drill head 91*t* drills and removes first the plug 145 and can next drill the wall of the bore hole according to said deviated path given by the guidance channel 79. The bit 3 then follows the deviated path given by the drilling string 89*t* and the drilling machine 87*t*, penetrating said wall and the formation to a desired depth.

There can be noted in FIG. 14 a membrane 147 which, when it is intact in its drawn position, prevents the fluid or fluids from passing to the outside of the destructible element 9. In fact, when the sleeve 15 has been sufficiently inflated, the fluid can be given a momentary excess pressure capable of piercing this membrane 147 so that, from this instant, fluid can escape at this location and rise again towards the bit 3.

At this stage of the operations, the removable assembly 83*t* which comprises the drilling machine 87*t* can be withdrawn using the stud 86 and this assembly 83*t* replaced, as in the case of the second embodiment above, with a customary inner coring tube 31 (FIGS. 18 to 20), already described.

In a variant of the third embodiment, when the drilling machine has penetrated the wall of the bore hole by a desired depth, a choice can be made to reduce the pressure of the coring fluid in the core barrel 1 so that the drilling machine 87*t* is no longer pushed forward into the formation and the head 91*t* no longer, or scarcely, drills. Under these conditions, if the bit 3 continues to advance into the destructible element 9 and/or the formation, the removable assembly 83*t* goes back into the core barrel 1, in the intermediate tube 81. The system comprising catch 139 and longitudinal groove 141 can be arranged in order that, from an in position of the removable assembly 83*t*, the catch 139 comes out of this groove 141. Consequently, the head 91*t* is then no longer driven rotationally and no longer advances at all into the formation. If the bit 3 is still driven rotationally and pushed forward, it can advance whilst being guided by the drilling machine 87*t* and/or its drilling string 89*t*.

It is apparent to persons skilled in the art that the second and third embodiments of the invention give the bit 3 a guidance superior to that given by the first embodiment, since the internal guide 7 in these two cases is disposed as far as beyond the interface between the destructible element 9 and the formation.

Moreover, in the second and third embodiments, if the drilling machine 87 or 87*t* is sent sufficiently deeply into the formation from the wall of the bore hole, the core cut will then consist quite entirely of formation and not of a first part consisting of debris from the destructible element 9 and a second part consisting of said formation with, between these two parts, an interface surface on a slant with respect to the coring direction.

It must be understood that the invention is in no way limited to the embodiments described and that many modifications can be made to the latter without departing from the scope of the claims.

In the description and the claims, the indicated order of the steps of the method seem presently favorable. However, modifications of this order must be considered as included within the scope of the claims.

The stabilization wings 77 of the destructible element 9 are depicted extending parallel to the longitudinal axis 41. They can however be of helical appearance.

There should be noted in FIGS. 3, 7, 10, 15 and 18 a mechanism 151, not detailed, which can be mounted in a variant or omitted, and which can

- be disposed between the outer tube 33 and the inner 31 or respectively intermediate 81 tube;
- have a large annular chamber 153;
- have a small annular chamber 155 connected to the large chamber 153 and which is open at least locally on the side of the core;
- be resting or fixed against the inside of the bit 3.

This mechanism 151 can comprise, in the small annular chamber 155, sensors of different types known in the art for performing detections and/or measurements in particular electrical ones on a core which enters the core barrel 1. The large annular chamber 153 is intended to receive devices for detections, measurements and/or recordings or even sending of data to the operators, connected to these sensors, not depicted.

The above-mentioned particular fluid can then be chosen and/or arranged in order to have electrical characteristics matched to the operation of these sensors, as is known.

Thus, from the moment a core enters the core barrel and before raising the latter to the surface, one or more measurements and/or detections of parameters of this core at the level of the bit 3 and recording and/or transmission to an operator of these measurements and/or detections can be performed. Said measurements and/or detections can be used to decide on actions to be undertaken during the deviated coring.

The guidance means 11 or channel 79 is principally depicted in the form of a tube in a major part of its length. It can however be any element fashioned to give the described result.

LEGEND FOR THE FIGURES

1 core barrel
3 core bit of 1
5 inner gauge bore of 2
7 internal guide
9 destructible element
11 guidance means
13 means of fixing 9 to the wall
15 annular sleeve
15A one end of 15
15B the other end of 15
17 means of expanding 10
19 annular chamber of 9
21 means of supplying 13 with fluid
23 blocking-up means or valve
24 holes for passage to 19
25 rod between 3 and 9
25A thickening of 25
27 nozzle of 3
28 washer on 25
28A nut on 25
29 rear end of 7
31 inner tube of 1
33 outer tube of 1
35 rear end of 9
37 lateral surface of 9
39 longitudinal channel of 7 and 9
41 longitudinal axis of 1
43 internal space of 31
45 piston system and piston
47 upper space of 43
49 lower space of 43
51 plug in a passage in 31
53 annular clearance of 45
55 O-rings on 45
57 transverse passage in 45
59 valve to 49
61 longitudinal passage in 45
63 surplus valve
65 surplus fluid outlet through 45
67 ball thrust bearing system
69 gap between 31 and 33
71 orifices to 69
73 orifice to 45
75 ball for closing off 73
77 stabilization wing
79 guidance channel
81 intermediate guidance tube
83 removable assembly
84 toothed coupling
85 centering means
86 coupling stud
87 drilling machine
89 drilling string
91 drill head
93 motor of 87
95 rear end of 93
97 removable tube
99 breakable pin
101 transverse sealing tube
103 longitudinal grooves
105 internal protuberances of 97
106 spring catch
107 longitudinal groove
109 rear end of 1
111 passages
113 selector piston
115 breakable pin
117 nozzle
119 external sleeve
121 breakable pin
122 transverse sealing tube
123 stopping shoulder
125 orifices in 89
127 orifices
129 space between 33 and 81
131 internal space of 31
133 distribution piston
135 valve of 133
137 stem of 135
138 ball
139 spring catch
141 longitudinal groove in 81
143 duct
145 plug of 79

147 membrane
151 mechanism
153 large annular chamber
155 small annular chamber

What is claimed is:

1. A method for coring through a wall of a bore hole which has been drilled previously in an underground formation, in order to carry out coring deviated transversely with respect to a longitudinal direction of the bore hole, the method being comprising:

selecting a core barrel provided with a core bit having an inner gauge bore;

arranging an internal guide within the core barrel, the internal guide comprising a material resistant to the abrasion of a bit;

disposing the internal guide inside at least the inner gauge bore before beginning a deviated coring operation, the internal guide disposed such that the bit can move along the internal guide;

extending the internal guide in front of the bit, according to a forward direction of coring thereof, with progressive deviation of the bit from the longitudinal direction towards the wall, following a desired deviated path direction;

detachably fixing to the bit, and in front thereof according to its forward direction of coring, a destructible element, the destructible element made of a material operable to be destroyed by the bit in the process of deviated coring, and dimensioned to be disposed in the bore hole, fixing a guidance means within the destructible element to give a deviated path direction to the internal guide in front of the bit;

initiating coring with the bit; and guiding the bit through cooperation between the inner gauge bore and the internal guide until the wall and the formation are penetrated to a desired depth following the deviated path.

2. The method according to claim 1 further comprising:

using the internal guide as the guidance means within the destructible element;

detachably fixing the destructible element to the wall of the bore hole at a location chosen for a deviated coring;

breaking of the detachable fixing between the bit and the destructible element;

setting into rotation and pushing forward the bit to follow the deviated path given by the internal guide, thereby coring through a portion of the destructible element; and penetrating the wall and the formation to a desired depth.

3. The method according to claim 1 further comprising arranging, as the guidance means within the destructible element, a guidance channel having one end substantially coaxial with the inner gauge bore and having a line corresponding to the desired deviated path;

disposing said internal guide comprising a drilling machine carried by a drilling string through the core barrel and the inner gauge bore and following the guidance channel;

drilling by the drilling machine in the wall of the bore hole according to the deviated path, the drilling string having a length chosen in order that, when the drilling machine is driven into the wall according to a chosen anchorage depth, the drilling string is engaged in at least the inner gauge bore of the bit;

breaking the detachable fixing between the bit and the destructible element; and setting into rotation and pushing forward the bit to follow the deviated path given by the drilling string and the drilling machine, thereby coring through a portion of the destructible element; and penetrating the wall and the formation to a desired depth.

4. The method according to claim 1 further comprising:

arranging a guidance channel as the guidance means within the destructible element, one end of the guidance channel substantially coaxial with the inner gauge bore and corresponding to the desired deviated path;

arranging said internal guide comprising a drilling machine, carried by a drilling string, through the core barrel and the inner gauge bore and following the guidance channel in the direction of the wall;

fixing the drilling machine to the core barrel such that it projects a desired distance outside the bit into the guidance channel;

fixing the destructible element to the wall of the bore hole;

breaking the detachable fixing between the bit and the destructible element;

setting into rotation and pushing forward of the bit and the drilling machine;

drilling by the machine in the wall of the bore hole according to said deviated path given by the guidance channel; and coring by the bit following the deviated path given by the drilling string and the drilling machine, through a portion of the destructible element and of said guidance channel and penetrating said wall and the formation to a desired depth.

5. A method according to claim 4, further comprising suspension of the pushing of the drilling machine and continuation of the rotation and pushing forward of the guided bit along the drilling machine and the drilling string.

6. A method according to claim 1 further comprising measuring at least one parameter of a core at the level of the bit after the core enters the core barrel and before raising the core barrel to the surface.

7. A device for coring through a wall of a bore hole which has previously been cored in an underground formation, in order to carry out coring and/or drilling deviated transversely from and with respect to a longitudinal direction of the bore hole, the device comprising:

a core barrel, provided with a core bit having an inner gauge bore;

an internal guide made of a material resistant to the abrasion of the bit;

prior to beginning a deviated coring, the internal guide disposed inside at least the inner gauge bore such that the bit can move along the internal guide;

the internal guide further extending in front of the bit according to a forward direction of coring thereof;

a destructible element:

fixed in a detachable manner in front of the bit according to the forward direction of coring thereof;

constructed from a material operable to be removed by the bit in the process of deviated coring;

dimensioned for being disposed within a selected bore hole; and in which a guidance means is fixedly arranged to give a deviated path direction to the internal guide in front of the bit; and the internal guide being kept fixed during said coring in order to give the bit the desired deviated path direction and progressively deviate the bit from said longitudinal direction towards the wall.

8. The device according to claim 7, wherein the destructible element comprises a means for selective fixing to a wall of the bore hole.

9. The device according to claim 8 further comprising the detachable fixing between the destructible element and the bit arranged to be detached by relative rotation of the bit with respect to the destructible element fixed to the bore hole wall.

10. The device according to claim 8 further comprising an annular sleeve for selectively fixing to the wall of the bore hole, the annular sleeve comprising:

an elastic material;

mounted on a radial periphery of the destructible element; and having and external diameter selectively expandable until it becomes wedged against the wall of the bore hole and having a means to cause the expansion and retain it.

11. The device according to claim 10 wherein the means for causing expansion comprises:

an annular chamber between the sleeve and the destructible element and a means for supplying the chamber with fluid; and a blocking-up means arranged to selectively block up the fluid supplied to the annular chamber.

12. The device according to claim 8 wherein:

the guidance channel comprises the destructible element, one end of which is substantially coaxial with the inner gauge bore of the bit and having a line corresponding to the desired deviated path;

the internal guide comprising a drilling machine carried by a drilling string, arranged through the core barrel and the inner gauge bore and following the guidance channel in the direction of said wall;

the drilling machine and drilling string mounted in the core barrel such that the machine projects by a given distance outside the bit into the guidance channel, a means being provided to at least temporarily keep the projection distance fixed.

13. The device according to claim 12 further comprising the drill head of the drilling machine coupled by the drilling string to the bit of the core barrel during rotational driving.

14. The device according to claim 7 further comprising the detachable fixing between the destructible element and the bit arranged to be detached by relative rotation of the bit with respect to the destructible element fixed to the bore hole wall.

15. The device according to claim 14, wherein the detachable fixing comprises at least one rod:

fixed through a nozzle of the bit;

having a tubular construction, open at one end turned towards the inside of the bit and through the nozzle, and closed at the other end, breakable between the bit and the destructible element during the rotation of the bit; and constructed from a material operable to be removed by coring fluid passing in the broken tubular rod and the corresponding nozzle.

16. The device according to claim 7 wherein the guidance means comprises an internal guide fixed in the destructible element.

17. The device according to claim 7 wherein:

the guidance means in the destructible element comprises a guidance channel having one end substantially coaxial with the inner gauge bore of the bit and having a line corresponding to the desired deviated path;

the internal guide comprising a drilling machine carried by a drilling string and operable to be conveyed through the core barrel and the inner gauge bore;

the internal guide following the guidance channel to drill and penetrate the wall of the bore hole according to the deviated path given by the guidance channel, the drilling string having a length chosen such that, when the drilling machine is driven into the wall according to an anchorage depth, the drilling string is engaged in at least the inner gauge bore of the bit.

* * * * *